US012256883B2

(12) United States Patent
Ebrahimi Afrouzi et al.

(10) Patent No.: US 12,256,883 B2
(45) Date of Patent: Mar. 25, 2025

(54) MOPPING EXTENSION FOR A ROBOTIC VACUUM

(71) Applicants: Ali Ebrahimi Afrouzi, Henderson, NV (US); Renee Bautista, San Francisco, CA (US); Soroush Mehrnia, Helsingborg (SE)

(72) Inventors: Ali Ebrahimi Afrouzi, Henderson, NV (US); Renee Bautista, San Francisco, CA (US); Soroush Mehrnia, Helsingborg (SE)

(73) Assignee: AI Incorporated, Toronto (CA)

( * ) Notice: Subject to any disclaimer, the term of this patent is extended or adjusted under 35 U.S.C. 154(b) by 0 days.

(21) Appl. No.: 18/392,516

(22) Filed: Dec. 21, 2023

(65) Prior Publication Data

US 2024/0156312 A1 May 16, 2024

Related U.S. Application Data

(63) Continuation of application No. 17/348,655, filed on Jun. 15, 2021, now Pat. No. 11,864,715, which is a (Continued)

(51) Int. Cl.
*A47L 7/00* (2006.01)
*A47L 5/00* (2006.01)
(Continued)

(52) U.S. Cl.
CPC ..... *A47L 7/0019* (2013.01); *A47L 5/00* (2013.01); *A47L 7/009* (2013.01); *A47L 9/00* (2013.01);
(Continued)

(58) Field of Classification Search
CPC ..... A47L 5/00; A47L 7/009; A47L 7/0019; A47L 9/00; A47L 9/0018; A47L 11/28;
(Continued)

(56) References Cited

U.S. PATENT DOCUMENTS

2006/0288519 A1* 12/2006 Jaworski ..... A47L 11/33 15/340.1

FOREIGN PATENT DOCUMENTS

KR 200381912 Y1 * 4/2005
KR 20120032029 A * 4/2012

OTHER PUBLICATIONS

KR 20120032029 A; Ziegler et al.; Apr. 4, 2012.*
KR 200381912 Y1; Apr. 20, 2005.*

* cited by examiner

*Primary Examiner* — Randall E Chin

(57) ABSTRACT

A method for cleaning a workspace, including: autonomously moving, with a mechanism of a robot, a cloth of a mopping assembly of the robot upwards and downwards relative to a work surface of the work space. The cloth is disengaged from the work surface when the cloth is moved upwards relative to the work surface such that the cloth is not in contact with the work surface. The cloth is engaged with the work surface when the cloth is moved downwards relative to the work surface such that the cloth is in contact with the work surface. The mechanism moves the cloth of the mopping assembly upwards and downwards relative to the work surface based on input provided by at least one sensor of the robot.

63 Claims, 9 Drawing Sheets

Related U.S. Application Data continuation of application No. 16/375,968, filed on Apr. 5, 2019, now Pat. No. 11,058,268, which is a continuation of application No. 14/970,791, filed on Dec. 16, 2015, now Pat. No. 10,292,553.

(60) Provisional application No. 62/155,733, filed on May 1, 2015, provisional application No. 62/092,802, filed on Dec. 16, 2014.

(51) Int. Cl.
*A47L 9/00* (2006.01)
*A47L 11/40* (2006.01)

(52) U.S. Cl.
CPC ..... *A47L 9/0018* (2013.01); *A47L 11/4036* (2013.01); *A47L 11/4088* (2013.01); *A47L 2201/00* (2013.01)

(58) Field of Classification Search
CPC . A47L 11/284; A47L 2201/00; A47L 2201/06
See application file for complete search history.

MOPPING EXTENSION FOR A ROBOTIC VACUUM

CROSS-REFERENCE TO RELATED APPLICATIONS

This application is a Continuation of Non-Provisional patent application Ser. No. 17/348,655, filed Jun. 15, 2021, now U.S. Pat. No. 11,864,715, which is a Continuation of Non-Provisional patent application Ser. No. 16/375,968, filed Apr. 5, 2019, which is a continuation of Non-Provisional patent application Ser. No. 14/970,791, filed Dec. 16, 2015, which claims the benefit of Provisional Patent Application Nos. 62/092,802, filed Dec. 16, 2014, and 62/155,733, filed May 1, 2015, each of which is hereby incorporated by reference.

FIELD OF THE DISCLOSURE

This disclosure relates to automated robotic devices, and more particularly, to robotic floor cleaning devices.

BACKGROUND

More efficient methods for cleaning are continuously sought after to meet consumer demands. This can be seen in robotic floor cleaning devices through software changes, such as improved navigation systems, and hardware changes, including stronger and more energy efficient motors, improved brush designs, improved debris storage containers, etc. Robotic floor cleaning devices also generally specialize in different functions, such as mopping, vacuuming, or polishing.

Previously, separate robotic devices for vacuuming and mopping floors have been introduced individually. Each of these apparatuses has only one function (mopping or vacuuming), which means that in order to thoroughly clean a work surface, a user would need to have a combination of devices and run them one after the other. This practice has a relatively high cost of ownership, high level of required maintenance, and long time to completion of a given workspace. A need exists for a method to provide vacuuming and mopping functions in a single robotic device.

SUMMARY

The following presents a simplified summary of some embodiments of the techniques described herein in order to provide a basic understanding of the invention. This summary is not an extensive overview of the invention. It is not intended to identify key/critical elements of the invention or to delineate the scope of the invention. Its sole purpose is to present some embodiments of the invention in a simplified form as a prelude to the more detailed description that is presented below.

Some embodiments include a method for cleaning a workspace, including: autonomously moving, with a mechanism of a robot, at least a cloth of a mopping assembly of the robot upwards and downwards relative to a work surface of the work space, wherein: the robot includes: a fluid reservoir for storing a cleaning fluid; and the mopping assembly includes the cloth for mopping the work surface, the cloth being oriented toward the work surface; the cloth is disengaged from the work surface when the at least the cloth is moved upwards relative to the work surface such that the cloth is not in contact with the work surface; the cloth is engaged with the work surface when the at least the cloth is moved downwards relative to the work surface such that the cloth is in contact with the work surface; the mechanism moves the at least the cloth of the mopping assembly upwards and downwards relative to the work surface based on input provided by at least one sensor of the robot; the robot includes at least one nozzle for delivery of the cleaning fluid; and the mechanism includes a motor for moving the at least the cloth of the mopping assembly upwards and downwards.

Some embodiments include a method for cleaning a workspace, including: a robot moving in the workspace while cleaning work surfaces of the workspace, wherein: the robot includes: a chassis; a drive system; a vacuuming module for vacuuming; a fluid reservoir for storing a cleaning fluid; a mopping extension positioned on a rear portion of the robot for mopping, including a cloth oriented towards the work surfaces; and at least one nozzle for delivery of the cleaning fluid; autonomously engaging at least the cloth with a first portion of work surfaces such that the cloth is in contact with the first portion of work surfaces; and autonomously disengaging the at least the cloth from a second portion of work surfaces such that the cloth is not in contact with the second portion of work surfaces, wherein the at least the cloth is autonomously disengaged from the second portion of work surfaces based on input provided by at least one sensor of the robot.

Some embodiments include a method for cleaning a workspace, including: a robot autonomously moving on a work surface of the workspace while cleaning the work surface, wherein the robot includes: a chassis; a drive system; a vacuuming module for vacuuming; and a mopping assembly including at least a mopping component for mopping; autonomously moving, with a mechanism of the robot, at least the mopping component upwards and downwards relative to the work surface, wherein: the robot further includes: a fluid reservoir for storing a cleaning fluid; and at least one nozzle for delivering the cleaning fluid; the mopping component is positioned in a rear portion of the robot; the mopping component is positioned in a downward position while the robot covers a first portion of the work surface; the mopping component is positioned in an upward position while the robot covers a second portion of the work surface; and the mopping component moves from the downward position upwards relative to the work surface to the upward position based on input captured by at least one sensor of the robot.

Some embodiments include a method for cleaning a workspace, including: cleaning, with a cloth of a mop assembly attached to a robotic floor cleaning device, a work surface, wherein: the robotic floor cleaning device includes: a chassis; a drive system configured to maneuver the robot over the work surface; right and left drive wheels; one or more obstacle detection sensors; and the mop assembly positioned on a rear portion of the robot and including: a fluid reservoir for storing one or more cleaning fluids; the cloth oriented towards the work surface and attached to a bottom side of the fluid reservoir; and one or more nozzles for delivery of the one or more cleaning fluids; at least a portion of the mop assembly is removable; and the at least the portion of the mopping assembly is detached from the robotic floor cleaning device by a user releasing a latch; delivering, continuously or at intervals, with the one or more nozzles, the one or more cleaning fluids to dampen the cloth.

Some embodiments include a method for cleaning a workspace, including: cleaning, with a cloth of a mop assembly attached to a robotic floor cleaning device, a work surface, wherein: the mop assembly includes: a frame for securing components; a cloth attachable to the frame oriented towards the work surface; a means for securing the frame to a body of the robotic floor cleaning device; a fluid reservoir for storing a cleaning fluid; nozzles to distribute the cleaning fluid; and electrodes electrically coupled to one or more components of the mop assembly to provide electricity thereto from a main battery of the robotic floor cleaning device for delivering cleaning fluid from the fluid reservoir; and the robotic floor cleaning device includes: a chassis; a drive system carried by the chassis configured to maneuver the robotic floor cleaning device over the work surface; right and left drive wheels; and one or more obstacle detection sensors.

Some embodiments include a method for cleaning a workspace, including: cleaning, with a suctioning cleaning assembly mounted on a chassis of an autonomous coverage robot, at least a first portion of a work surface; cleaning, with a cloth of a mopping cleaning attachment mounted on a rearward portion of the chassis, at least a second portion of the work surface, wherein: the autonomous coverage robot includes: the chassis; a drive system carried by the chassis configured to maneuver the robot over the work surface; right and left drive wheels; one or more obstacle detection sensors; and the mopping cleaning attachment, including: a frame for securing components of the mopping cleaning attachment; the cloth attachable to the frame, a bottom surface of the cloth contacting the work surface for wiping the work surface; a fluid reservoir for storing a cleaning fluid; and nozzles to distribute the cleaning fluid to the cloth.

Some embodiments include a method for disengaging at least one component of a mopping assembly of a robot from a first portion of a work surface of a workspace, including: a robot autonomously moving on the work surface while mopping and vacuuming the work surface during a same cleaning session, wherein the robot includes: a fluid reservoir for storing a cleaning fluid; a chassis; a drive system carried by the chassis configured to maneuver the robot over the work surface; right and left drive wheels; and one or more obstacle detection sensors; moving, with a mechanism of the robot, the at least one component of the mopping assembly of the robot relative to the work surface, wherein: the mopping assembly includes at least one nozzle for delivery of the cleaning fluid; the mopping assembly is positioned on a rear portion of the robot; the at least one component of the mopping assembly is disengaged from the first portion of the work surface based on input provided by at least one sensor of the robot; and the at least one component is not in contact with the first portion of the work surface when disengaged from the first portion of the work surface.

DETAILED DESCRIPTION OF SOME EMBODIMENTS

The present invention will now be described in detail with reference to a few embodiments thereof as illustrated in the accompanying drawings. In the following description, numerous specific details are set forth in order to provide a thorough understanding of the present inventions. It will be apparent, however, to one skilled in the art, that the present invention may be practiced without some or all of these specific details. In other instances, well known process steps and/or structures have not been described in detail in order to not unnecessarily obscure the present invention. Further, it should be emphasized that several inventive techniques are described, and embodiments are not limited to systems implanting all of those techniques, as various cost and engineering trade-offs may warrant systems that only afford a subset of the benefits described herein or that will be apparent to one of ordinary skill in the art.

Some embodiments provide both mopping functionality and vacuuming functionality in a single robotic floor cleaning device.

Some embodiments provide a comprehensive autonomous floor-cleaning method that is less expensive than currently available robotic systems.

Some embodiments increase the cleaning effectiveness of a vacuuming robot.

Some embodiments eliminate the need for multiple floor-cleaning robots to thoroughly clean an area.

Some embodiments minimize the amount of user maintenance required in using robotic systems to clean floors.

Some embodiments provide a solution that minimizes the amount of time required to complete a comprehensive floor-cleaning job.

Some embodiments provide a mopping extension unit for an automated robotic vacuum to enable the device to simultaneously vacuum and mop work surfaces. The provisioned mopping extension would improve the cleaning effectiveness of a robotic vacuum and reduce (and in some cases eliminate) the need for a dedicated mopping robot to run after a dedicated vacuuming robot.

In some embodiments, a mopping extension may be installed in a dedicated compartment in the chassis of an automated robotic vacuum. In some embodiments, a cloth positioned on the mopping extension is dragged along the work surface as the automated robotic vacuum drives through the area. In some embodiments, nozzles direct fluid from a cleaning fluid reservoir to the mopping cloth. The dampened mopping cloth may further improve cleaning efficiency. In some embodiments, the mopping extension further comprises a means for moving back and forth in a horizontal plane parallel to the work surface during operation. In some embodiments, the mopping extension further comprises a means for moving up and down in a vertical plane perpendicular to the work surface to engage or disengage the mopping extension.

Figure 1:
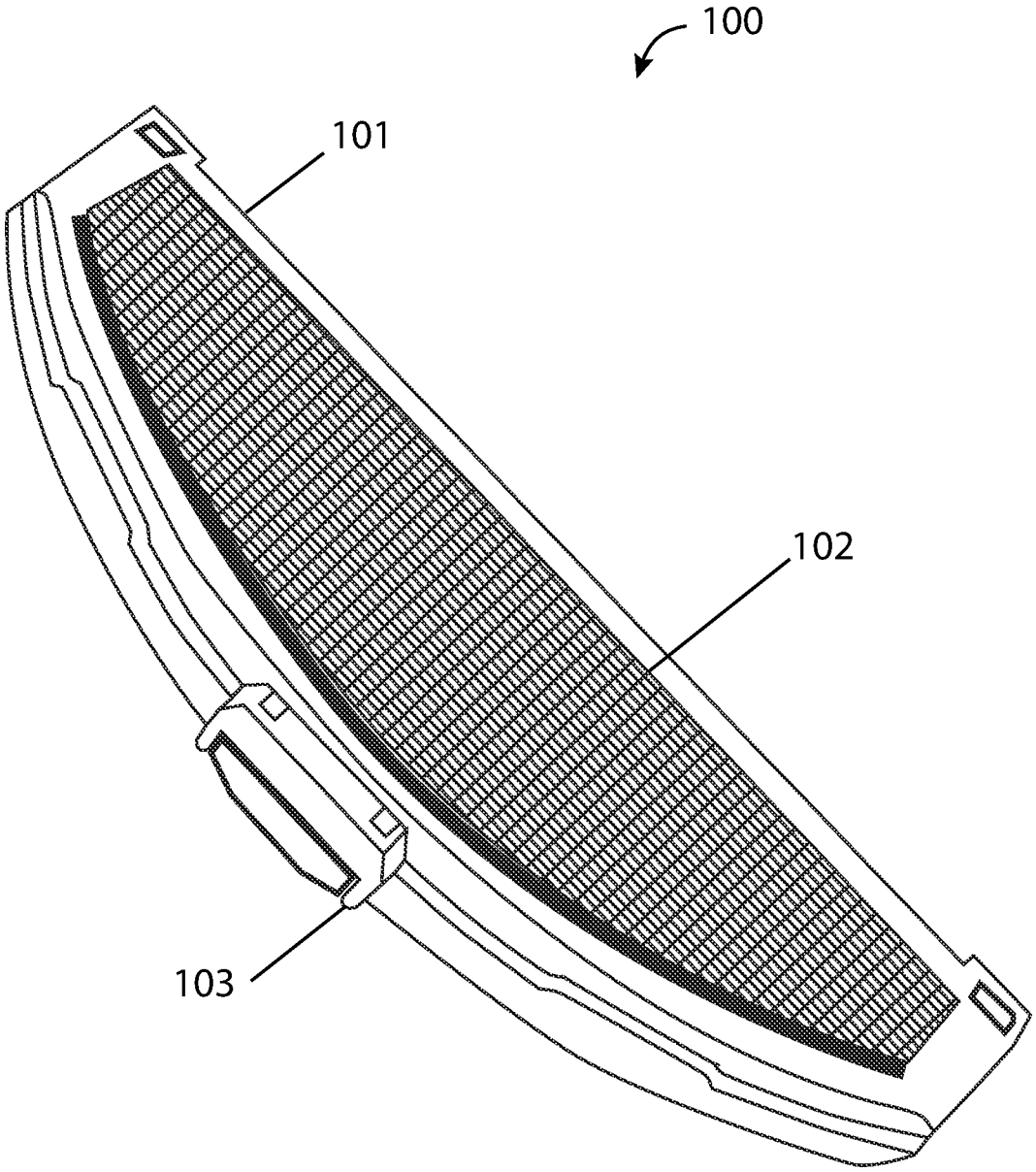
FIG. 1 illustrates a bottom view of a mopping extension in accordance with some embodiments.

In some embodiments, a detachable mopping extension that may be installed inside a dedicated compartment with the chassis of a robotic floor cleaning device is provisioned. FIG. 1 illustrates a bottom view of an example of a detachable mopping extension 100. In some embodiments, the mopping extension may be attached to the chassis of a robotic floor cleaning device (not shown). The mopping extension includes a frame 101 that supports a removable mopping cloth 102 and a latch 103 to secure and release the mopping extension to and from the robotic floor cleaning device.

Figure 2:
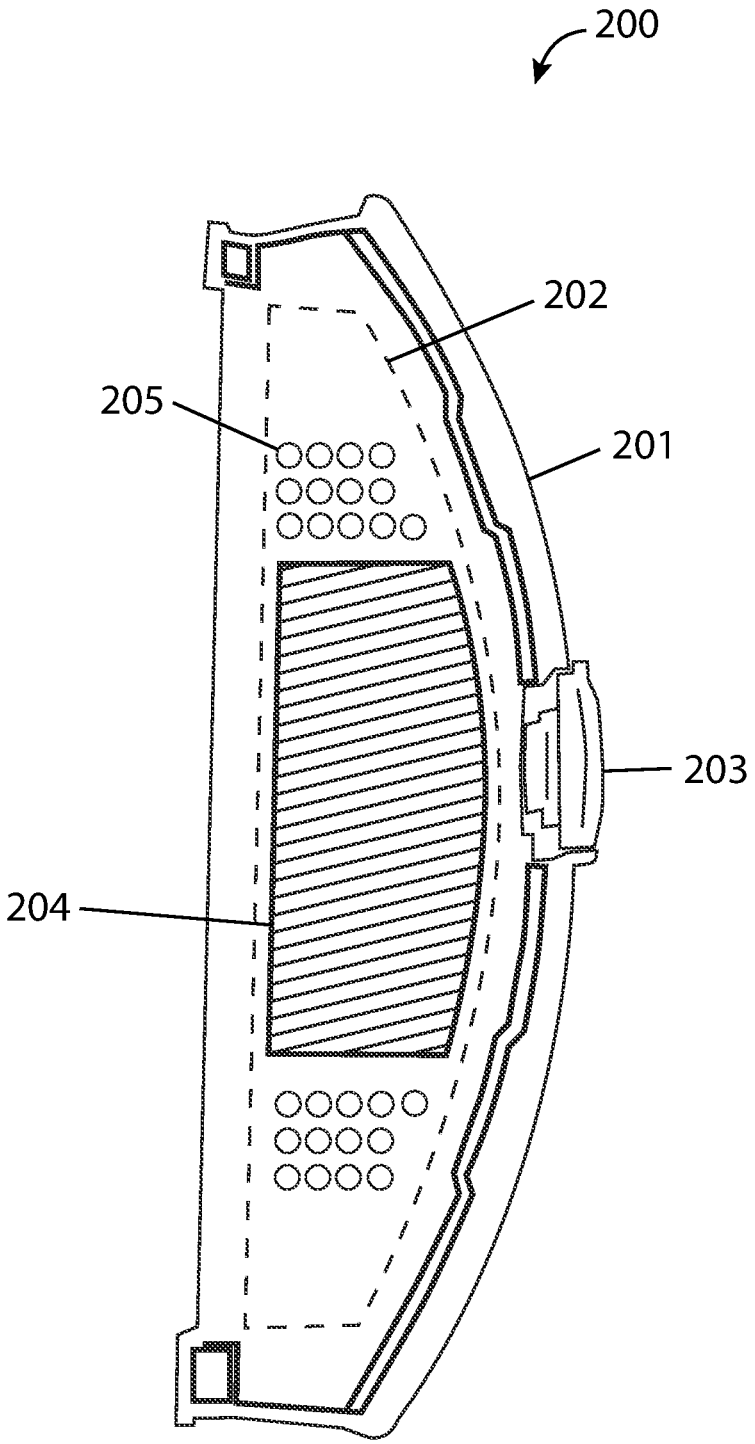
FIG. 2 illustrates a top view of a mopping extension with internal components in accordance with some embodiments.

FIG. 2 illustrates an example of internal components of a mopping extension 200. The frame 201 supports the mop components. A latch 203 secures the mopping extension to the chassis of the robotic device and may be released to detach the mopping extension. In some embodiments, the mopping extension further includes a refillable fluid reservoir 204 that stores cleaning fluid to be dispersed by nozzles 205 onto the mopping cloth 202. In some embodiments, the nozzles continuously deliver a constant amount of cleaning fluid to the mopping cloth. In some embodiments, the nozzles periodically deliver predetermined quantities of cleaning fluid to the cloth.

Figure 3:
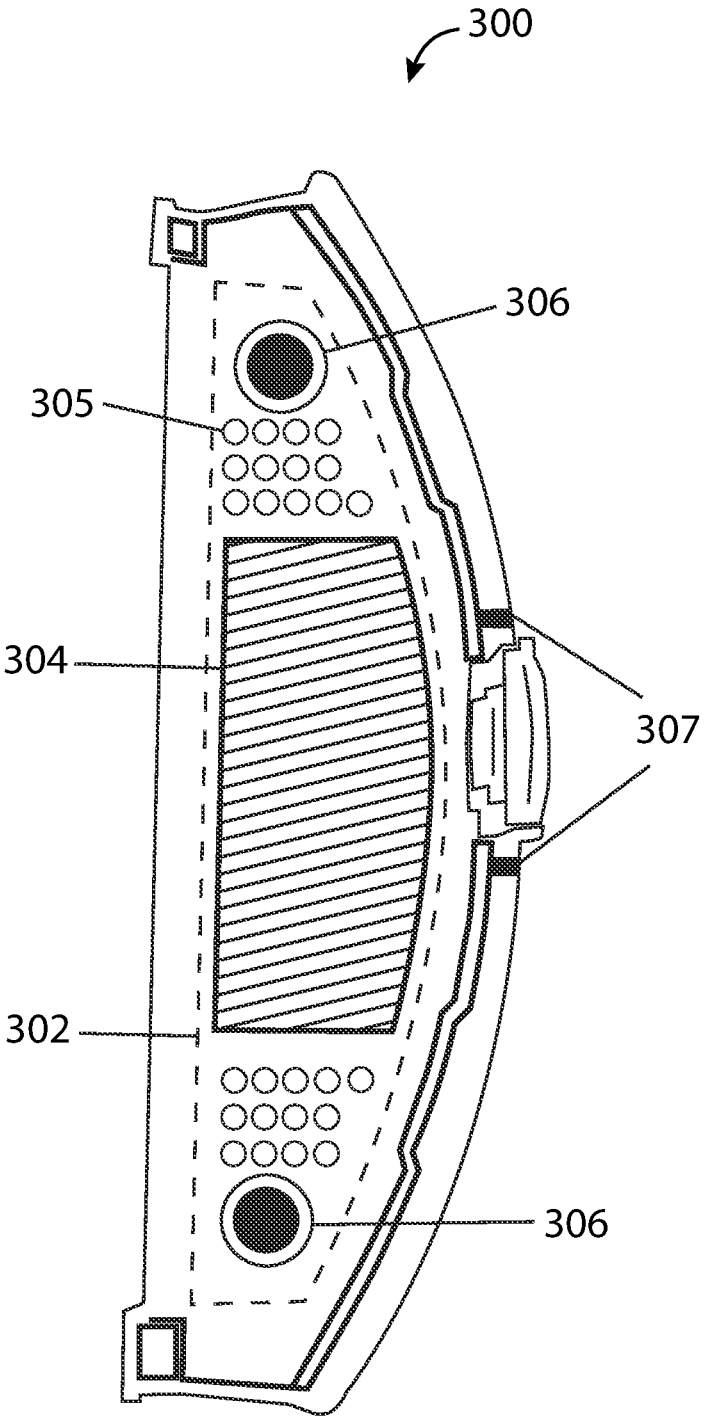
FIG. 3 illustrates a top view of a mopping extension with ultrasonic oscillators in accordance with some embodiments.

FIG. 3 illustrates an example of a mopping extension 300 with a set of ultrasonic oscillators 306 that vaporize fluid from the reservoir 304 before it is delivered through the nozzles 305 to the mopping cloth 302. Metal electrodes 307 provide power from a main battery (not shown) of the robotic device to the ultrasonic oscillators. In some embodiments, the ultrasonic oscillators vaporize fluid continuously at a low rate to continuously deliver vapor to the mopping cloth. In some embodiments, the ultrasonic oscillators turn on at predetermined intervals to deliver vapor periodically to the mopping cloth.

Figure 4A:
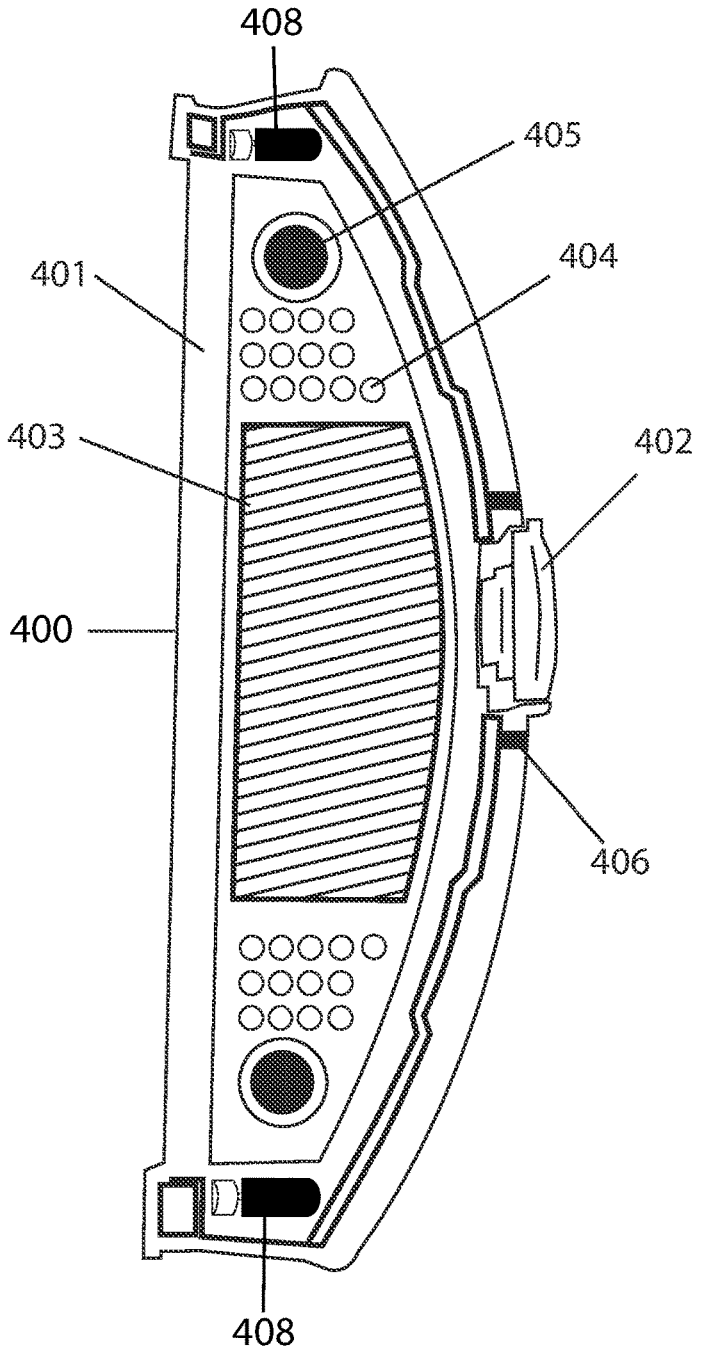
FIG. 4A illustrates a top view of a mopping extension with eccentric rotating mass vibration motors to provide vibrations to the mopping extension in accordance with some embodiments.
Figure 4B:
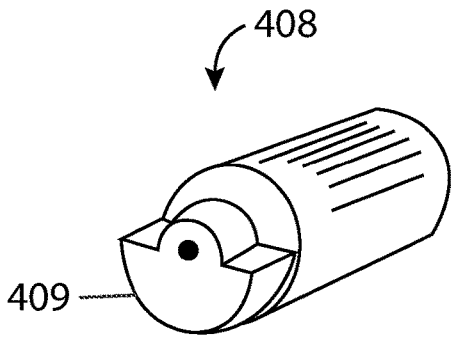
FIG. 4B illustrates a perspective view of an eccentric rotating mass vibration motor in accordance with some embodiments.

In some embodiments, the mopping extension includes a means to vibrate the mopping extension during operation. FIG. 4A illustrates an example of a top side of a mopping extension 400. The mopping extension 400 includes a frame 401 that supports a removable mopping cloth and a latch 402 to secure and release the mopping extension to and from a robotic floor cleaning device. The mopping extension further includes a refillable fluid reservoir 403 that stores cleaning fluid to be dispersed by nozzles 404 onto the mopping cloth. In some embodiments, the nozzles continuously deliver a constant amount of cleaning fluid to the mopping cloth. In some embodiments, the nozzles periodically deliver predetermined quantities of cleaning fluid to the cloth. The mopping extension 400 also includes a set of ultrasonic oscillators 405 that vaporize fluid from the reservoir 403 before it is delivered through the nozzles 404 to the mopping cloth. Metal electrodes 406 provide power from a main battery (not shown) of the robotic device to the ultrasonic oscillators. In some embodiments, the ultrasonic oscillators vaporize fluid continuously at a low rate to continuously deliver vapor to the mopping cloth. In some embodiments, the ultrasonic oscillators turn on at predetermined intervals to deliver vapor periodically to the mopping cloth. The mopping extension further includes eccentric rotating mass vibration motors 408. FIG. 4B illustrates a close up perspective view of an eccentric rotating mass vibration motor 408. Eccentric rotating mass vibration motors rely on the rotation of an unbalanced counterweight 409 to provide vibrations to the mopping extension.

Figure 5:
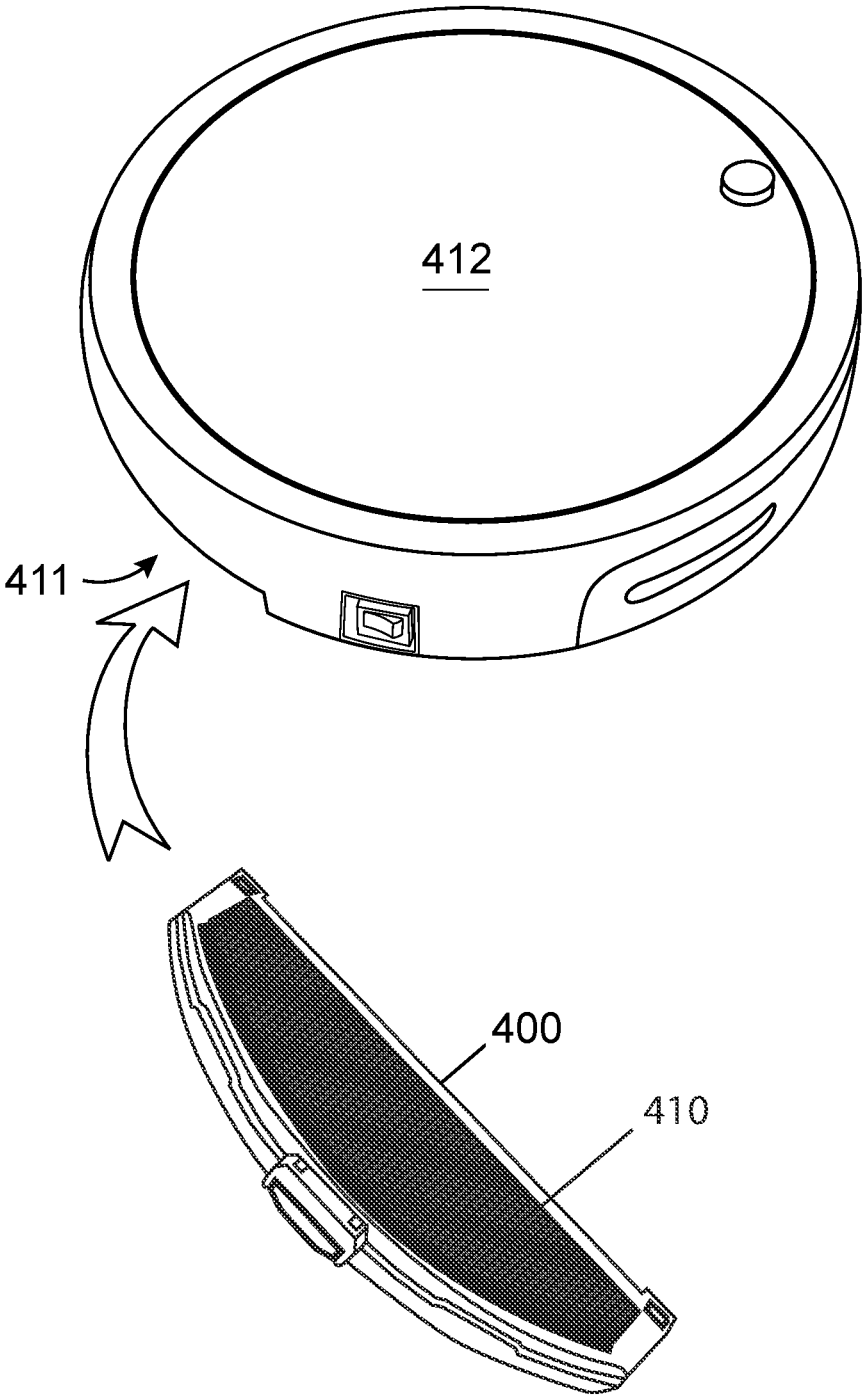
FIG. 5 illustrates the insertion of a mopping extension into a compartment in the chassis of a robotic vacuum in accordance with some embodiments.

FIG. 5 illustrates an example of the robotic vacuum to which mopping extension 400 may be attached. The mopping extension 400 with mopping cloth 410 fits into a compartment 411 on the underside of the robotic vacuum 412 such that the cloth 410 attached to the bottom side of the mopping extension may be caused to make contact with the work surface as the robotic vacuum 412 drives.

Figure 6:
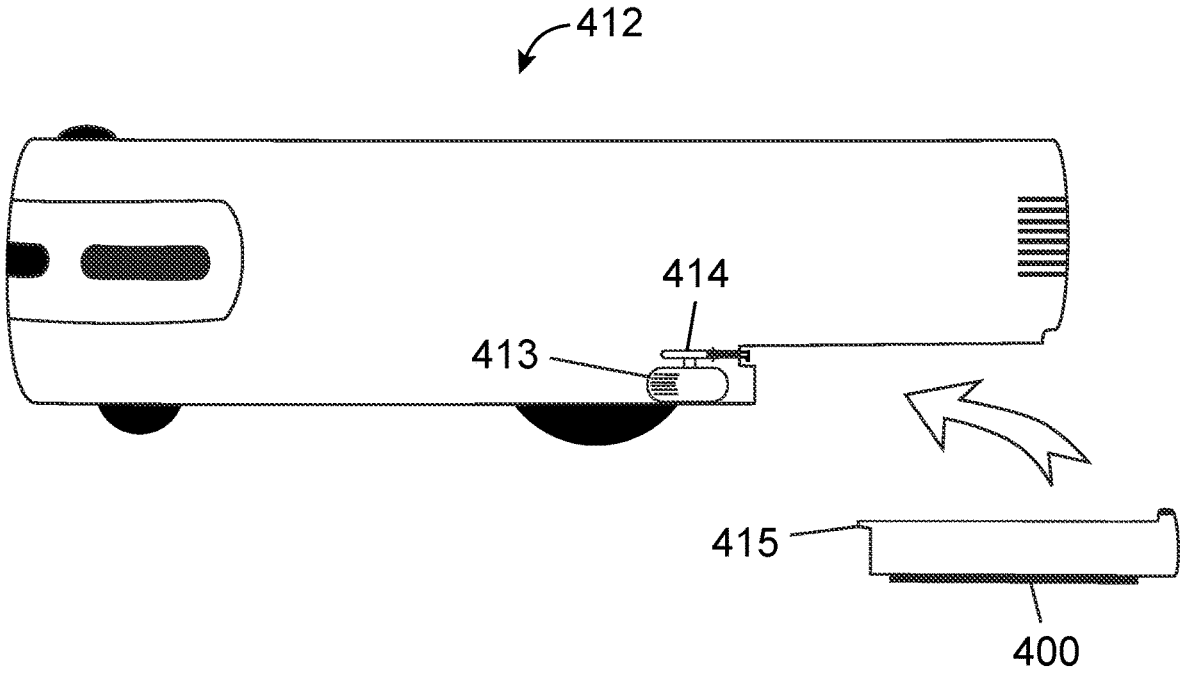
FIG. 6 illustrates a side view of a robotic vacuum with a motor to move a mopping extension back and forth during operation in accordance with some embodiments.

In some embodiments, the mopping extension includes a means to move the mopping extension back and forth in a horizontal plane parallel to the work surface during operation. FIG. 6 illustrates a side elevation view of the robotic vacuum 412 with a mechanism for moving the mopping extension 400 back and forth. An electric motor 413 positioned inside the chassis of the robotic vacuum 412 transfers movements to the mopping extension 400 through a rod 414 to tabs 415 on the mopping extension.

Figure 7A:
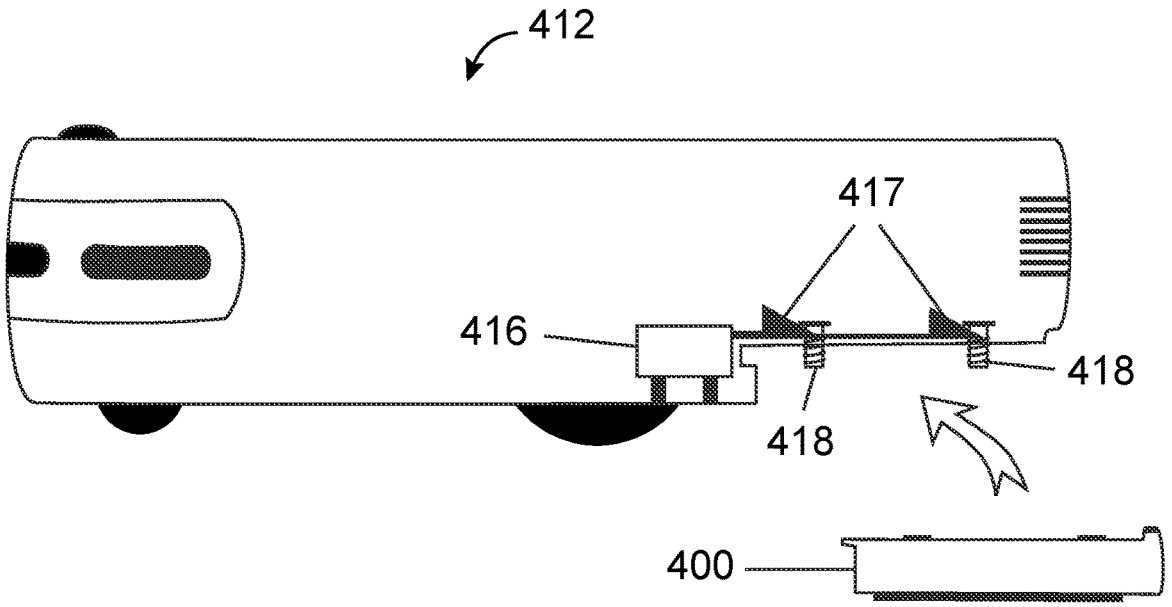
FIG. 7A illustrates a side view of a robotic vacuum with a mechanism for engaging and disengaging a mopping extension in an engaged position in accordance with some embodiments.
Figure 7B:
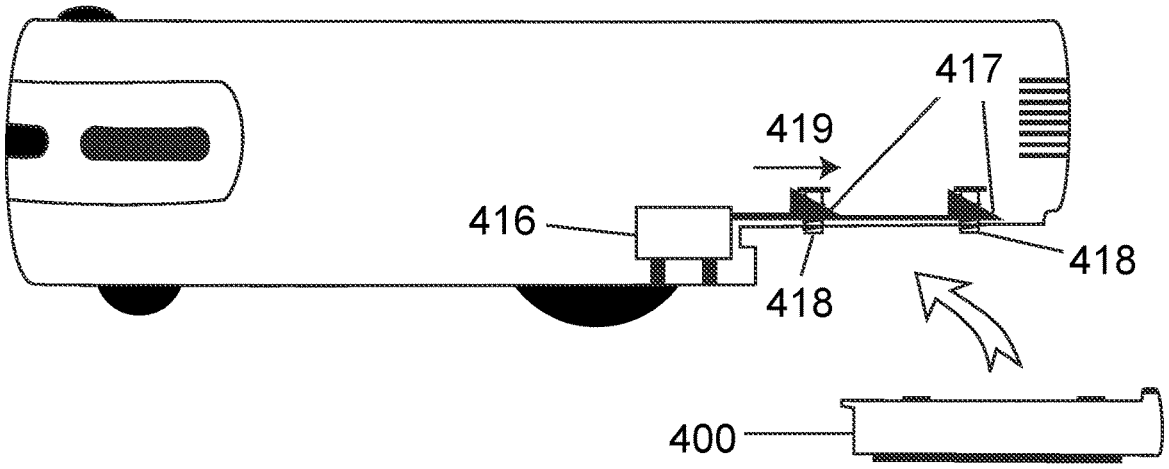
FIG. 7B illustrates a side view of a robotic vacuum with a mechanism for engaging and disengaging a mopping extension in a disengaged position in accordance with some embodiments.

In some embodiments, the mopping extension includes a means to engage and disengage the mopping extension during operation by moving the mopping extension up and down in a vertical plane perpendicular to the work surface. In some embodiments, engagement and disengagement may be manually controlled by a user. In some embodiments, engagement and disengagement may be controlled automatically based on sensory input. FIG. 7A illustrates a side view of the robotic vacuum 412 with a means for engaging and disengaging a mopping extension 400. The mopping extension is shown not attached to the robotic vacuum and not all components of the robotic vacuum are shown in this example to more clearly show details. An electric servomotor 416 positioned within the chassis of the robotic vacuum 412 pushes forward and pulls back wedges 417 that raise and lower springs 418 to which the mopping extension 400 may be attached. When the wedges are pulled back, as shown in FIG. 7A, the mopping extension 400, when attached, will be engaged. Referring to FIG. 7B, when the wedges 417 are pushed forward in a direction 419 by the electric servomotor 416, the springs 418 are raised and the mopping extension 400 is disengaged.

Figure 8A:
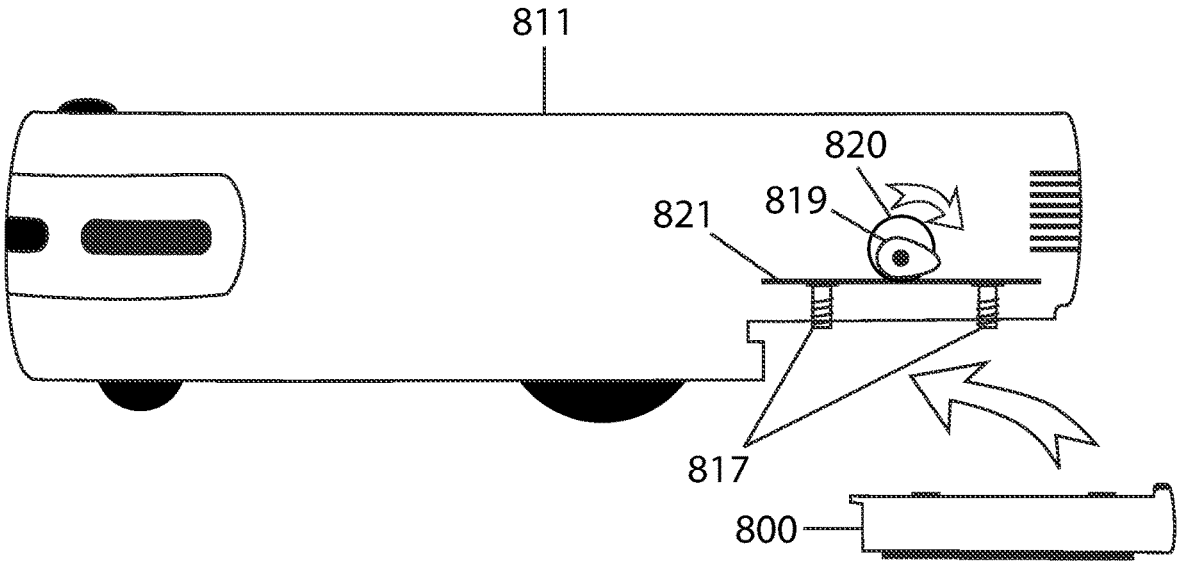
FIG. 8A illustrates a side view of a robotic vacuum with an alternative mechanism for engaging and disengaging a mopping extension in a disengaged position in accordance with some embodiments.
Figure 8B:
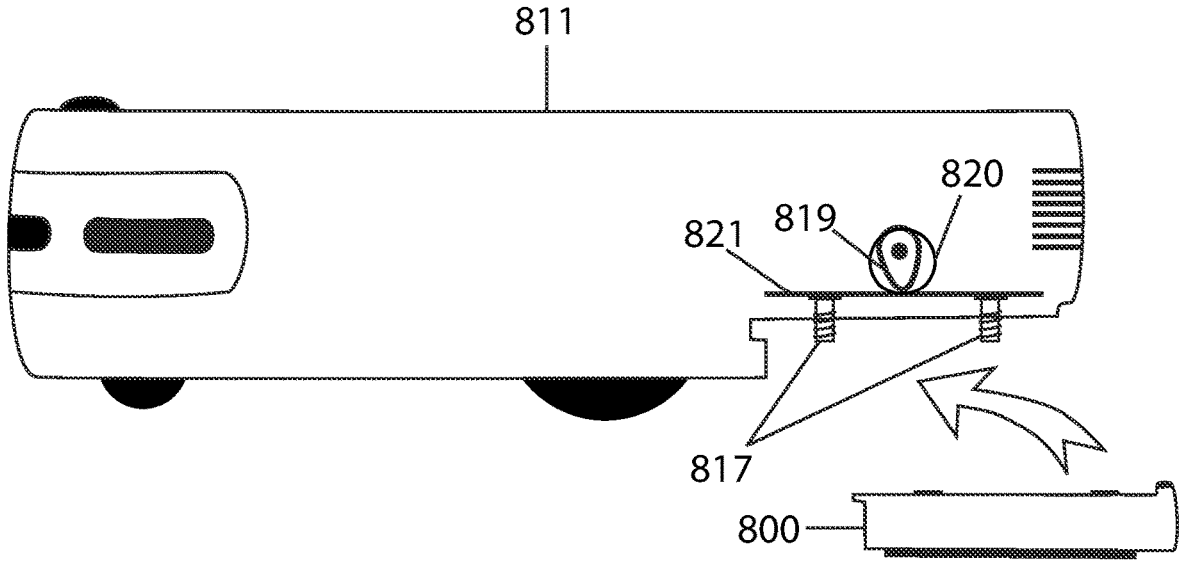
FIG. 8B illustrates a side view of a robotic vacuum with an alternative mechanism for engaging and disengaging a mopping extension in an engaged position according in accordance with embodiments.

FIG. 8A and FIG. 8B illustrate an example of an alternate method for engaging and disengaging a mopping extension. An oval wheel 819 positioned in the chassis of a robotic vacuum 811 is turned by an electric motor 820, which causes the wheel to push down a plate 821. When the wheel is not pushing the plate down, springs 817 are not pushed down and the mopping extension 800 is not engaged. In FIG. 8B the wheel 819 is pushing down the plate 821 causing the springs 817 to be pushed down which lowers the mopping extension 800, engaging it.

Figure 9A:
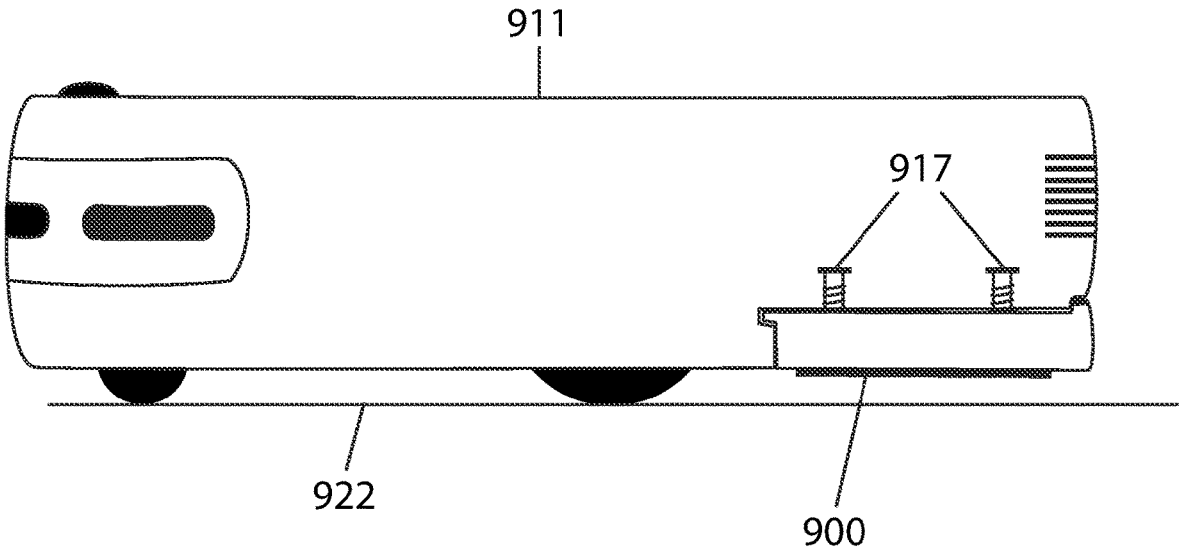
FIG. 9A illustrates a side view of a robotic vacuum with a mopping extension attached in a disengaged position in accordance with some embodiments.
Figure 9B:
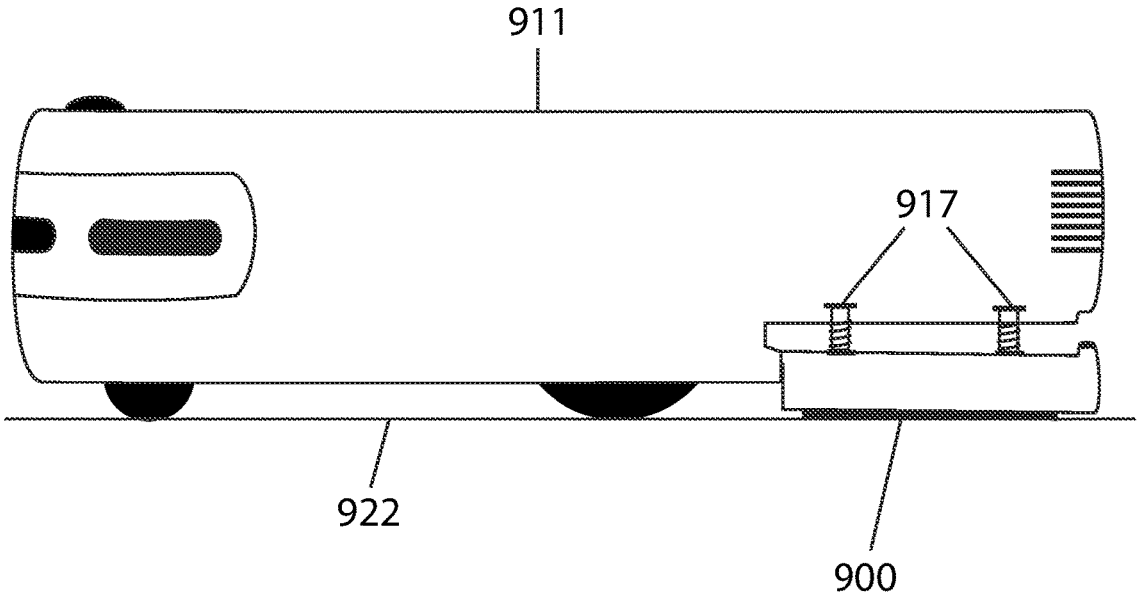
FIG. 9B illustrates a side view of a robotic vacuum with a mopping extension attached in an engaged position in accordance with some embodiments.

FIGS. 9A and 9B illustrate and example of a robotic vacuum 911 with a mopping extension 900 attached. In FIG. 9A, the springs 917 are not lowered and the mopping extension 900 is in a disengaged position, where the mopping extension cannot make contact with the work surface 922. In FIG. 9B the springs 917 are lowered and the mopping extension 900 is in an engaged position, such that the mopping extension makes contact with the work surface 922.

In block diagrams, illustrated components are depicted as discrete functional blocks, but embodiments are not limited to systems in which the functionality described herein is organized as illustrated. The functionality provided by each of the components may be provided by specialized software or specially designed hardware modules that are differently organized than is presently depicted; for example, such software or hardware may be intermingled, conjoined, replicated, broken up, distributed (e.g. within a data center or geographically), or otherwise differently organized. The functionality described herein may be provided by one or more processors of one or more computers executing specialized code stored on a tangible, non-transitory, machine readable medium. In some cases, notwithstanding use of the singular term "medium," the instructions may be distributed on different storage devices associated with different computing devices, for instance, with each computing device having a different subset of the instructions, an implementation consistent with usage of the singular term "medium" herein. In some cases, third party content delivery networks may host some or all of the information conveyed over networks, in which case, to the extent information (e.g., content) is said to be supplied or otherwise provided, the information may be provided by sending instructions to retrieve that information from a content delivery network.

The reader should appreciate that the present application describes several independently useful techniques. Rather than separating those techniques into multiple isolated patent applications, applicants have grouped these techniques into a single document because their related subject matter lends itself to economies in the application process. But the distinct advantages and aspects of such techniques should not be conflated. In some cases, embodiments address all of the deficiencies noted herein, but it should be understood that the techniques are independently useful, and some embodiments address only a subset of such problems or offer other, unmentioned benefits that will be apparent to those of skill in the art reviewing the present disclosure. Due to costs constraints, some techniques disclosed herein may not be presently claimed and may be claimed in later filings, such as continuation applications or by amending the present claims. Similarly, due to space constraints, neither the Abstract nor the Summary of the Invention sections of the present document should be taken as containing a comprehensive listing of all such techniques or all aspects of such techniques.

It should be understood that the description and the drawings are not intended to limit the present techniques to the particular form disclosed, but to the contrary, the intention is to cover all modifications, equivalents, and alternatives falling within the spirit and scope of the present techniques as defined by the appended claims. Further modifications and alternative embodiments of various aspects of the techniques will be apparent to those skilled in the art in view of this description. Accordingly, this description and the drawings are to be construed as illustrative only and are for the purpose of teaching those skilled in the art the general manner of carrying out the present techniques. It is to be understood that the forms of the present techniques shown and described herein are to be taken as examples of embodiments. Elements and materials may be substituted for those illustrated and described herein, parts and processes may be reversed or omitted, and certain features of the present techniques may be utilized independently, all as would be apparent to one skilled in the art after having the benefit of this description of the present techniques. Changes may be made in the elements described herein without departing from the spirit and scope of the present techniques as described in the following claims. Headings used herein are for organizational purposes only and are not meant to be used to limit the scope of the description.

As used throughout this application, the word "may" is used in a permissive sense (i.e., meaning having the potential to), rather than the mandatory sense (i.e., meaning must). The words "include", "including", and "includes" and the like mean including, but not limited to. As used throughout this application, the singular forms "a," "an," and "the" include plural referents unless the content explicitly indicates otherwise. Thus, for example, reference to "an element" or "a element" includes a combination of two or more elements, notwithstanding use of other terms and phrases for one or more elements, such as "one or more." The term "or" is, unless indicated otherwise, non-exclusive, i.e., encompassing both "and" and "or." Terms describing conditional relationships, e.g., "in response to X, Y," "upon X, Y,", "if X, Y," "when X, Y," and the like, encompass causal relationships in which the antecedent is a necessary causal condition, the antecedent is a sufficient causal condition, or the antecedent is a contributory causal condition of the consequent, e.g., "state X occurs upon condition Y obtaining" is generic to "X occurs solely upon Y" and "X occurs upon Y and Z." Such conditional relationships are not limited to consequences that instantly follow the antecedent obtaining, as some consequences may be delayed, and in conditional statements, antecedents are connected to their consequents, e.g., the antecedent is relevant to the likelihood of the consequent occurring. Statements in which a plurality of attributes or functions are mapped to a plurality of objects (e.g., one or more processors performing steps A, B, C, and D) encompasses both all such attributes or functions being mapped to all such objects and subsets of the attributes or functions being mapped to subsets of the attributes or functions (e.g., both all processors each performing steps A-D, and a case in which processor 1 performs step A, processor 2 performs step B and part of step C, and processor 3 performs part of step C and step D), unless otherwise indicated. Further, unless otherwise indicated, statements that one value or action is "based on" another condition or value encompass both instances in which the condition or value is the sole factor and instances in which the condition or value is one factor among a plurality of factors. Unless otherwise indicated, statements that "each" instance of some collection have some property should not be read to exclude cases where some otherwise identical or similar members of a larger collection do not have the property, i.e., each does not necessarily mean each and every. Limitations as to sequence of recited steps should not be read into the claims unless explicitly specified, e.g., with explicit language like "after performing X, performing Y," in contrast to statements that might be improperly argued to imply sequence limitations, like "performing X on items, performing Y on the X'ed items," used for purposes of making claims more readable rather than specifying sequence. Statements referring to "at least Z of A, B, and C," and the like (e.g., "at least Z of A, B, or C"), refer to at least Z of the listed categories (A, B, and C) and do not require at least Z units in each category. Unless specifically stated otherwise, as apparent from the discussion, it is appreciated that throughout this specification discussions utilizing terms such as "processing," "computing," "calculating," "determining" or the like refer to actions or processes of a specific apparatus, such as a special purpose computer or a similar special purpose electronic processing/computing device. Features described with reference to geometric constructs, like "parallel," "perpendicular/orthogonal," "square", "cylindrical," and the like, should be construed as encompassing items that substantially embody the properties of the geometric construct, e.g., reference to "parallel" surfaces encompasses substantially parallel surfaces. The permitted range of deviation from Platonic ideals of these geometric constructs is to be determined with reference to ranges in the specification, and where such ranges are not stated, with reference to industry norms in the field of use, and where such ranges are not defined, with reference to industry norms in the field of manufacturing of the designated feature, and where such ranges are not defined, features substantially embodying a geometric construct should be construed to include those features within 15% of the defining attributes of that geometric construct. The terms "first", "second", "third," "given" and so on, if used in the claims, are used to distinguish or otherwise identify, and not to show a sequential or numerical limitation.

The invention claimed is:

1. A method for cleaning a workspace, comprising:

autonomously moving, with a mechanism of a robot, at least a cloth of a mopping assembly of the robot upwards and downwards relative to a work surface of the work space, wherein:

the robot comprises:

a fluid reservoir for storing a cleaning fluid; and the mopping assembly comprises the cloth for mopping the work surface, the cloth being oriented toward the work surface;

the cloth is disengaged from the work surface when the at least the cloth is moved upwards relative to the work surface such that the cloth is not in contact with the work surface;

the cloth is engaged with the work surface when the at least the cloth is moved downwards relative to the work surface such that the cloth is in contact with the work surface;

the mechanism moves the at least the cloth of the mopping assembly upwards and downwards relative to the work surface based on input provided by at least one sensor of the robot;

the robot comprises at least one nozzle for delivery of the cleaning fluid; and the mechanism comprises a motor for moving the at least the cloth of the mopping assembly upwards and downwards; and the robot comprises mopping functionality and vacuuming functionality for mopping and vacuuming the work surface during a same cleaning session.

2. The method of claim 1, wherein mopping and vacuuming by the robot during the same cleaning session reduces an amount of time required to complete cleaning the work surface by reducing or eliminating a need for a separate dedicated mopping cleaning session of the work surface after a separate dedicated vacuuming cleaning session of the work surface.

3. The method of claim 1, wherein mopping and vacuuming functionalities of the robot reduces or eliminates the need for an additional robot for dedicated vacuuming or mopping.

4. The method of claim 3, wherein eliminating the need for the additional robot reduces consumer costs.

5. The method of claim 1, wherein a determined quantity of the cleaning fluid is delivered in intervals or continuously.

6. The method of claim 1, wherein electrodes are electrically coupled with at least one mopping assembly to provide electricity thereto from a main battery of the robot.

7. The method of claim 1, wherein the robot further comprises at least one ultrasonic component.

8. The method of claim 1, wherein at least one motor of the robot comprises a servomotor.

9. The method of claim 1, further comprising:

vibrating, oscillating, or moving at least a portion of the mopping assembly.

10. The method of claim 9, wherein the vibrating, oscillating, or moving of the at least the portion of the mopping assembly is actuated by an ultrasonic component or a motor.

11. The method of claim 1, wherein the cloth attaches to a bottom side of the mopping assembly.

12. The method of claim 1, further comprising:

moving at least a part of the mopping assembly in a plane parallel to the work surface.

13. The method of claim 1, wherein the mopping assembly is positioned on a rear portion of the robot.

14. The method of claim 13, wherein a vacuuming assembly is positioned on a front portion of the robot.

15. A method for cleaning a workspace, comprising:

a robot moving in the workspace while cleaning work surfaces of the workspace, wherein:

the robot comprises:

a chassis;

a drive system;

a vacuuming module for vacuuming;

a fluid reservoir for storing a cleaning fluid;

a mopping extension positioned on a rear portion of the robot for mopping, comprising a cloth oriented towards the work surfaces; and at least one nozzle for delivery of the cleaning fluid;

autonomously engaging at least the cloth with a first portion of work surfaces such that the cloth is in contact with the first portion of work surfaces;

autonomously disengaging the at least the cloth from a second portion of work surfaces such that the cloth is not in contact with the second portion of work surfaces, wherein the at least the cloth is autonomously disengaged from the second portion of work surfaces based on input provided by at least one sensor of the robot; and the robot comprises mopping functionality and vacuuming functionality for mopping and vacuuming the work surface during a same cleaning session.

16. The method of claim 15, wherein disengaging the at least the cloth from the second portion of work surfaces comprises:

moving the at least cloth upwards relative to the second portion of work surfaces.

17. The method of claim 16, wherein engaging the at least the cloth with the first portion of work surfaces comprises:

moving the at least cloth downwards relative to the first portion of work surfaces.

18. The method of claim 17, further comprising:

moving the at least the cloth in a plane parallel to the work surfaces.

19. The method of claim 15, wherein at least a portion of the mopping extension is removable.

20. The method of claim 15, wherein at least one component of the mopping extension is moved back and forth in relation to the workspace in a plane parallel to the work surfaces.

21. The method of claim 20, wherein the at least one component of the mopping extension is moved back and forth in relation to the robot.

22. The method of claim 21, wherein the at least one component of the mopping extension is moved back and forth within a concentrated area.

23. The method of claim 15, wherein the mopping extension comprises:

a first electric motor for actuating engagement of the at least the cloth with the first portion of work surfaces and disengagement of the at least the cloth from the second portion of work surfaces; and a second electric motor for actuating vibration, oscillation, back and forth movement, or rotation of at least a portion of the mopping extension.

24. The method of claim 23, wherein at least one of the electric motors comprises a servomotor.

25. The method of claim 15, wherein a determined quantity of the cleaning fluid is delivered from the fluid reservoir.

26. The method of claim 25, wherein the cleaning fluid is dispensed continuously or at intervals at a constant rate.

27. The method of claim 15, wherein electrodes electrically coupled with at least one component of the mop extension provide electricity thereto from a main battery of the robot.

28. The method of claim 15, wherein the robot further comprises at least one ultrasonic component.

29. The method of claim 15, wherein:

the robot comprises at least one oscillating component; and the at least one oscillating component operates continuously when the cloth is engaged with the first portion of work surfaces.

30. The method of claim 15, wherein at least a portion of a vacuuming module is positioned on a front portion of the robot.

31. A method for cleaning a workspace, comprising:

a robot autonomously moving on a work surface of the workspace while cleaning the work surface, wherein the robot comprises:

a chassis;

a drive system;

a vacuuming module for vacuuming; and a mopping assembly comprising at least a mopping component for mopping;

autonomously moving, with a mechanism of the robot, at least the mopping component upwards and downwards relative to the work surface, wherein:

the robot further comprises:

a fluid reservoir for storing a cleaning fluid; and at least one nozzle for delivering the cleaning fluid;

the mopping component is positioned in a rear portion of the robot;

the mopping component is positioned in a downward position while the robot covers a first portion of the work surface;

the mopping component is positioned in an upward position while the robot covers a second portion of the work surface; and the mopping component moves from the downward position upwards relative to the work surface to the upward position based on input captured by at least one sensor of the robot; and the robot comprises mopping functionality and vacuuming functionality for mopping and vacuuming the work surface during a same cleaning session.

32. The method of claim 31, further comprising:

vibrating, oscillating, or moving back and forth, with a motor, at least a portion of the mopping assembly.

33. The method of claim 31, wherein the robot further comprises at least an ultrasonic component.

34. The method of claim 31, wherein at least a portion of the mopping assembly is detachable from the robot.

35. The method of claim 31, wherein:

a determined quantity of the cleaning fluid is delivered directly or indirectly to the first portion of the work surface;

the mopping component comprises a cloth attached to a bottom side of the mopping assembly; and the cloth is detachable from the mopping assembly.

36. The method of claim 31, wherein the robot comprises a servomotor.

37. The method of claim 31, wherein:

the mopping component engages with the first portion of the work surface when in the downward position such that the mopping component is in contact with the first portion of the work surface; and the mopping component disengages from the second portion of the work surface when in the upward position such that the mopping component is not in contact with the second portion of the work surface.

38. The method of claim 37, wherein an engagement of the mopping component with and an disengagement of the mopping component from the respective work surface coincides with operation of at least one additional motor to vibrate a component of the robot of the mopping assembly.

39. The method of claim 31, wherein at least a portion of a vacuuming module is positioned on a front portion of the robot.

40. A method for cleaning a workspace, comprising:

cleaning, with a cloth of a mop assembly attached to a robotic floor cleaning device, a work surface, wherein:

the robotic floor cleaning device comprises:

a chassis;

a drive system configured to maneuver the robot over the work surface;

right and left drive wheels;

one or more obstacle detection sensors; and the mop assembly positioned on a rear portion of the robot and comprising:

a fluid reservoir for storing one or more cleaning fluids;

the cloth oriented towards the work surface and attached to a bottom side of the fluid reservoir; and one or more nozzles for delivery of the one or more cleaning fluids;

at least a portion of the mop assembly is removable; and the at least the portion of the mopping assembly is detached from the robotic floor cleaning device by a user releasing a latch; and the robotic floor cleaning device comprises mopping functionality and vacuuming functionality for mopping and vacuuming the work surface during a same cleaning session, delivering, continuously or at intervals, with the one or more nozzles, the one or more cleaning fluids to dampen the cloth.

41. The method of claim 40, wherein at least a portion of a vacuuming module is positioned on a front portion of the robotic floor cleaning device.

42. The method of claim 40, wherein mopping and vacuuming by the robotic floor cleaning device during the same cleaning session reduces an amount of time required to complete cleaning of the work by reducing or eliminating a need for a separate dedicated mopping cleaning session after a separate dedicated vacuuming cleaning session.

43. The method of claim 40, wherein mopping and vacuuming functionalities of the robotic floor cleaning device reduces or eliminates the need for an additional robot for dedicated vacuuming or mopping, thereby reducing consumer costs.

44. The method of claim 40, wherein the robotic floor cleaning device further comprises electrodes electrically coupled to one or more components of the mop assembly to provide electricity thereto from a main battery of the robotic floor cleaning device for delivering the one or more cleaning fluids from the fluid reservoir.

45. A method for cleaning a workspace, comprising:
cleaning, with a cloth of a mop assembly attached to a robotic floor cleaning device, a work surface, wherein:
the mop assembly comprises:
a frame for securing components;
a cloth attachable to the frame oriented towards the work surface;
a means for securing the frame to a body of the robotic floor cleaning device;
a fluid reservoir for storing a cleaning fluid;
nozzles to distribute the cleaning fluid; and
electrodes electrically coupled to one or more components of the mop assembly to
provide electricity thereto from a main battery of the robotic floor cleaning device for delivering cleaning fluid from the fluid reservoir; and
the robotic floor cleaning device comprises:
a chassis;
a drive system carried by the chassis configured to maneuver the robotic floor cleaning device over the work surface;
right and left drive wheels;
one or more obstacle detection sensors; and
mopping functionality and vacuuming functionality for mopping and vacuuming the work surface during a same cleaning session.

46. The method of claim 45, wherein the mop assembly is positioned in a rear portion of the robotic floor cleaning device.

47. The method of claim 45, wherein mopping and vacuuming by the robot during the same cleaning session reduces an amount of time required to complete cleaning of the work by reducing or eliminating a need for a separate dedicated mopping cleaning session after a separate dedicated vacuuming cleaning session.

48. The method of claim 45, wherein mopping and vacuuming functionalities of the robot reduces or eliminates the need for an additional robot for dedicated vacuuming or mopping, thereby reducing consumer costs.

49. The method of claim 45, wherein at least a portion of a vacuuming module is positioned on a front portion of the robotic floor cleaning device.

50. The method of claim 45, wherein the robotic floor cleaning device further comprises at least one ultrasonic component.

51. The method of claim 50, wherein the at least one ultrasonic component oscillates.

52. The method of claim 51, wherein oscillation of the at least one ultrasonic component creates vapor.

53. The method of claim 52, wherein a determined amount of vapor is delivered to the cloth at intervals.

54. A method for cleaning a workspace, comprising:
cleaning, with a suctioning cleaning assembly mounted on a chassis of an autonomous coverage robot, at least a first portion of a work surface;
cleaning, with a cloth of a mopping cleaning attachment mounted on a rearward portion of the chassis, at least a second portion of the work surface, wherein:
the autonomous coverage robot comprises:
the chassis;
a drive system carried by the chassis configured to maneuver the robot over the work surface;
right and left drive wheels;
one or more obstacle detection sensors; and
the mopping cleaning attachment, comprising:
a frame for securing components of the mopping cleaning attachment;
the cloth attachable to the frame, a bottom surface of the cloth contacting the work surface for wiping the work surface;
a fluid reservoir for storing a cleaning fluid; and
nozzles to distribute the cleaning fluid to the cloth; and
the autonomous coverage robot comprises mopping functionality and vacuuming functionality for mopping and vacuuming the work surface during a same cleaning session.

55. The method of claim 54, wherein:
the nozzles control delivery of the cleaning fluid; and
the cleaning fluid is delivered continuously to the cloth through the nozzles.

56. The method of claim 54, wherein:
mopping and vacuuming by the autonomous coverage robot during the same cleaning session reduces an amount of time required to complete cleaning of the work surface; and
mopping and vacuuming functionalities of the robot reduces or eliminates the need for an additional robot for dedicated vacuuming or mopping, thereby reducing consumer costs.

57. A method for disengaging at least one component of a mopping assembly of a robot from a first portion of a work surface of a workspace, comprising:
a robot autonomously moving on the work surface while mopping and vacuuming the work surface during a same cleaning session, wherein the robot comprises:
a fluid reservoir for storing a cleaning fluid;
a chassis;
a drive system carried by the chassis configured to maneuver the robot over the work surface;
right and left drive wheels; and
one or more obstacle detection sensors;
moving, with a mechanism of the robot, the at least one component of the mopping assembly of the robot relative to the work surface, wherein:
the mopping assembly comprises at least one nozzle for delivery of the cleaning fluid;
the mopping assembly is positioned on a rear portion of the robot;
the at least one component of the mopping assembly is disengaged from the first portion of
the work surface based on input provided by at least one sensor of the robot; and
the at least one component is not in contact with the first portion of the work surface when disengaged from the first portion of the work surface.

58. The method of claim 57, wherein the mechanism comprises at least a motor for moving the at least one component of the mopping assembly upwards to disengage from the first portion of the work surface.

59. The method of claim 57, wherein:

the at least one component of the mopping assembly is engaged with a second portion of the work surface based on the input provided by the at least one sensor.

60. The method of claim 59, wherein:

the at least one component comprises a cloth of the mopping assembly;

the robot comprises a vacuum motor;

at least a portion of a vacuuming module is positioned on a front portion of the robot; and a determined quantity of the cleaning fluid is delivered from the fluid reservoir.

61. The method of claim 57, wherein the robot comprises at least one ultrasonic component.

62. The method of claim 57, further comprising:

vibrating the at least one component of the mopping assembly.

63. The method of claim 57, further comprising:

moving the at least one component of the mopping assembly back and forth in a concentrated area of the work surface in a plane parallel to the work surface.

* * * * *